United States Patent [19]

Khachaturian et al.

[11] 4,397,493

[45] Aug. 9, 1983

[54] SPREADER BAR ASSEMBLY

[75] Inventors: Jon E. Khachaturian; Joseph P. Charles, both of Harvey, La.

[73] Assignee: Versabar, Inc., Harvey, La.

[21] Appl. No.: 300,059

[22] Filed: Sep. 8, 1981

[51] Int. Cl.[3] ..... B66C 1/10

[52] U.S. Cl. ..... 294/81 R

[58] Field of Search ..... 294/67 R, 67 DA, 67 DB, 294/67 E, 67 EA, 74–76, 78 R, 81 R, 81 SF, 82 AH

[56] References Cited

U.S. PATENT DOCUMENTS

| | | | |
|---|---|---|---|
| 2,020,174 | 11/1935 | Derossi | 294/67 E |
| 2,730,398 | 1/1956 | Huested | 294/81 R |
| 3,021,166 | 2/1962 | Kempel et al. | 294/74 |
| 3,519,302 | 7/1970 | Orenstein | 294/74 |
| 4,215,891 | 8/1980 | Thiele | 294/81 R X |

FOREIGN PATENT DOCUMENTS

| | | | |
|---|---|---|---|
| 2301571 | 8/1973 | Fed. Rep. of Germany | 294/81 R |
| 1101157 | 1/1968 | United Kingdom | 294/74 |

*Primary Examiner*—Johnny D. Cherry

*Attorney, Agent, or Firm*—Charles C. Garvey

[57] ABSTRACT

A spreader bar assembly provides a rigid elongated support of uniform cross-section (for example, a section of pipe). A pair of lifting eye assemblies are connected during the lifting operation at each respective end portion of the bar, each forming a connection with an above supporting bridle line and a depending lift line, each of the lifting eye assemblies comprising in part a socket of uniform cross-section receptive of one end of said bar thereinto and having a corresponding internal cross-section equal to or slightly larger than the external cross-section of the support bar. A stop is provided within the socket for limiting the penetration of the bar into the socket.

18 Claims, 6 Drawing Figures

SPREADER BAR ASSEMBLY

BACKGROUND OF THE INVENTION

1. Field of the Invention

The present invention relates to spreader bars and like lifting devices. More particularly, the present invention relates to a spreader bar assembly having end portions which can be removably fitted to the ends of a section of pipe, for example, or a like structural member which has been precut to a desired length.

2. General Background

In the lifting of equipment such as for loading onto ships or for construction, a crane normally provides a single load line which branches at a bridle and attaches in two portions to an elongated bar known in the art as a spreader bar. The spreader bar then has one or more depending load lines lowered from it at each end which are affixed to a piece of equipment to be lifted. This apparatus per se and the use of spreader bars is generally known in the art.

Spreader bars are normally custom constructed to fit a piece of equipment of a given load and dimension, and thus cannot be reused except on a piece of equipment of similar dimension and equal or lesser load. Attempts have been made in various United States patents to teach a method for providing an adjustable spreader bar which could be used over a variety of spreader lengths.

In U.S. Pat. No. 4,128,267 entitled "Lifting Beam" there can be seen a lifting beam comprising an elongate member carrying one or more pivotally mounted hooks for engagement of a load to be lifted. A balance weight is provided on the hooks to lie on either side of the pivotal axis thereof so as to cause the hook to be biased into or from engagement of the load to be picked up or released when the beam is lowered on to same.

In U.S. Pat. No. 4,136,903 there can be seen a "Tire Lifting Apparatus" which comprises a master support sleeve, two movable arms slideably associated therewith, and two hook units pivotably connected to the arms for easy engagement with the inner rim of a tire.

A "Handling Beam for Heavy Elongate Objects" can be seen in U.S. Pat. No. 3,762,756 which comprises a simple and reliable missile handling beam assembly readily engageable with conventional missile supporting lug arrangements. The assembly does not impose any stress on the object being handled, since a lifting hook can be located in a position closest to the center of gravity of the load, hence the attitude of the object can be easily controlled during the lifting and lowering movements.

In U.S. Pat. No. 4,258,949 entitled "Extensible Spreader Frame for Cargo Containers" there can be seen an extensible lifting spreader frame comprising a pair of oppositely extending beam arms slideably received within a central pair of side-by-side connected sleeve beams. Beam cross arms at the outer ends of the sleeve beams mount twist-lock latching hooks at their opposite ends for attachment to the four socketed top corners of a cargo container to be lifted.

A "Sling Mounting Head" for use with a spacer element and mounting two members of a sling chain can be seen in U.S. Pat. No. 4,215,891. The sling mounting head has a body portion including a central section, and first and second end sections extending from the central section.

In U.S. Pat. No. 3,206,243 issued to B. F. Miles on Sep. 14, 1965, there is seen a "Spreader Bar" apparatus.

U.S. Pat. No. 3,010,751 entitled "Adjustable Lift Hooks" issued on Nov. 28, 1961 to E. J. Day, et al.

A "Sling Carrier" device is seen in U.S. Pat. No. 3,252,729 which issued on May 24, 1966, to R. A. Holmes.

Many of these devices are highly complex in nature and because of their construction would necessarily be limited to relatively small loads.

Thus, there is a need for a simple, easy to use, easy to construct spreader bar which could easily be adapted to a variety of load and dimensional situations.

3. General Discussion of the Present Invention

The present invention solves these prior art problems and shortcomings in a simple manner by providing a spreader bar assembly which utilizes a rigid elongated central support bar of uniform cross-section such as, for example, an elongated section of pipe which can be precut to a desired length. A pair of lifting eye assemblies are connected during the lifting operation at each respective end portion of the bar to form removable connection with the bar and also with an above supporting bridle line, each of the lifting eye assemblies comprising in part a socket of uniform cross-section receptive of one end of said bar therein and having a corresponding internal cross-section equal to or slightly larger than the external cross-section of the support bar. A stop is provided for limiting the degree of penetration of the support bar into the respective socket. In the preferred embodiment, the central support bar is an elongated section of cylindrical pipe and the sockets are cylindrical, being of an equal or slightly larger internal diameter to the external diameter of the section of pipe.

The sockets are preferably open ended at one end portion and terminate at an inner stop. A plate is affixed rigidly to the socket and extends downwardly and rearwardly therefrom away from the open end portion of the socket. At least one opening is provided in the plate whch is receptive of the bridle and lifting lines. If desired, a pair of spaced apart openings can be provided in the plate, one for the bridle line and one for the downwardly depending load line. The lift opening for the bridle lift line can be located concentric with the elongated support bar, eliminating the potential for bending moment in the bar regardless of the length of bridle used. Gusseting can be provided on the plate for stiffening the plate, with the guesseting in the preferred embodiment being affixed by welding, for example, to the end of the socket and tangent to the socket with the gusset plates crossing.

The openings can be reinforced by thickening at their periphery for added strength.

From the above, one skilled in the art will see that the end lifting eye assemblies are freely removable from the pipe and thus could be reused over and over again by the attachment to lengths of pipe of desired precut dimensions. It can be seen also that the present invention allows for the use of a wide variety of sling lengths during lift due to the positioning of the bridle line openings. This would provide a spreader bar of high structural integrity, capable of lifting very heavy loads on the order of, for example, several hundred tons yet lend itself to the variety of dimensional situations.

Thus, it is an object of the present invention to provide a spreader bar assembly which can be adapted to a variety of dimensional situations without having to reconstruct the entire bar with each lift.

Another object of the present invention is to provide a spreader bar assembly with removable end lifting portions which could be added to a desired central spreader bar portion of desired dimensions.

Another object of the present invention is to provide a spreader bar assembly which is highly versatile, easy to construct, and of high structural integrity.

Another object of the present invention is to provide a spreader bar which is not generally dependent upon a certain required sling length for lift, allowing for a wide variation in sling or bridle lengths.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
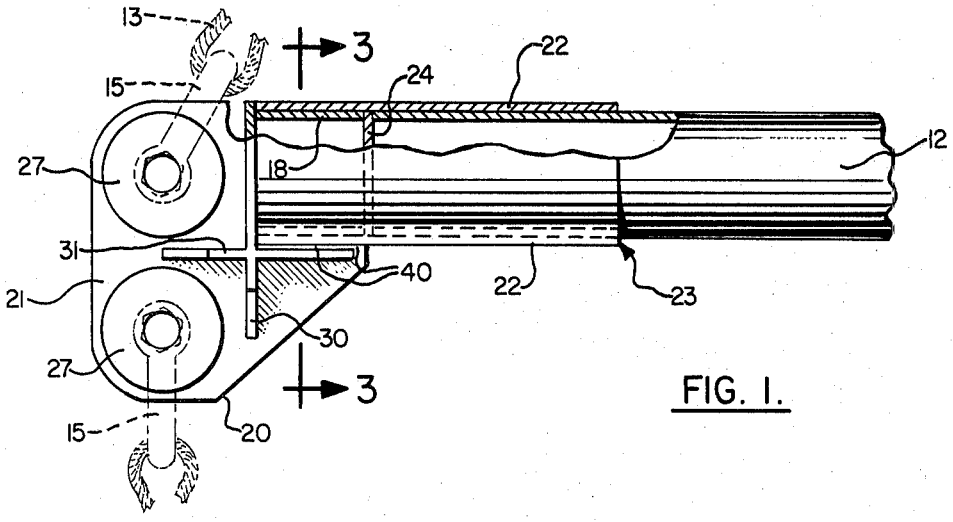
FIG. 1 is a partial side view of the preferred embodiment of the apparatus of the present invention.

FIGS. 1–5 illustrate the preferred embodiment of the apparatus of the present invention designated generally in the drawings by the numeral 10.

Figure 4:
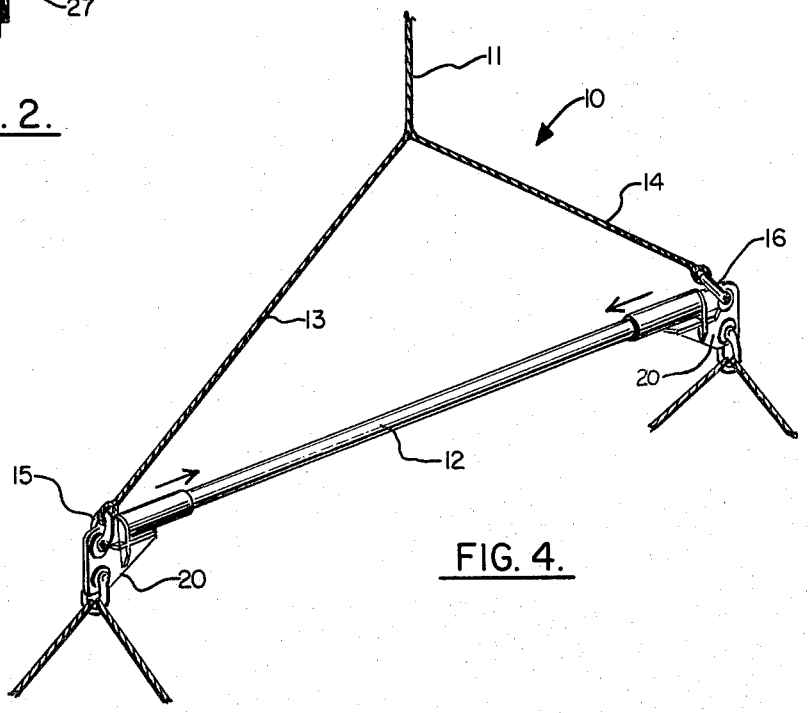
FIG. 4 is a perspective view of the preferred embodiment of the apparatus of the present invention illustrating a general lifting arrangement.

In FIG. 4 there can be seen a lift line 11 which would be, for example, the lift line of a crane, or like lifting device. Line 11 branches into a pair of bridle lines 13, 14, which terminate at shackles 15, 16 or like connection means for attaching bridle lines 13, 14 to the end lifting eye assembly 20 at opening 25. At opening 26, shackles 15, 16 are affixed to which one or more depending load lines 55 which attach with the lower end of load lines 55 attaching to the load to be lifted. A central structural bar 12 such as pipe, for example, attaches at its end portions to lifting eye assemblies 20 in a slip-on freely removable manner as will be decribed more fully. The compression applied to each lifting eye assembly 20, forcing it inwardly in the direction shown by the arrows in FIG. 4, is the only force necessary to retain the lifting eyes 20 upon bar 12 during operation. An auxiliary line (not shown) could connect eye assemblies 20 during assembly or prior to a lift to prevent inadvertent removal of either eye assembly 20 prior to lifting. Such a line could be of light material as rope, for example.

Figure 5:
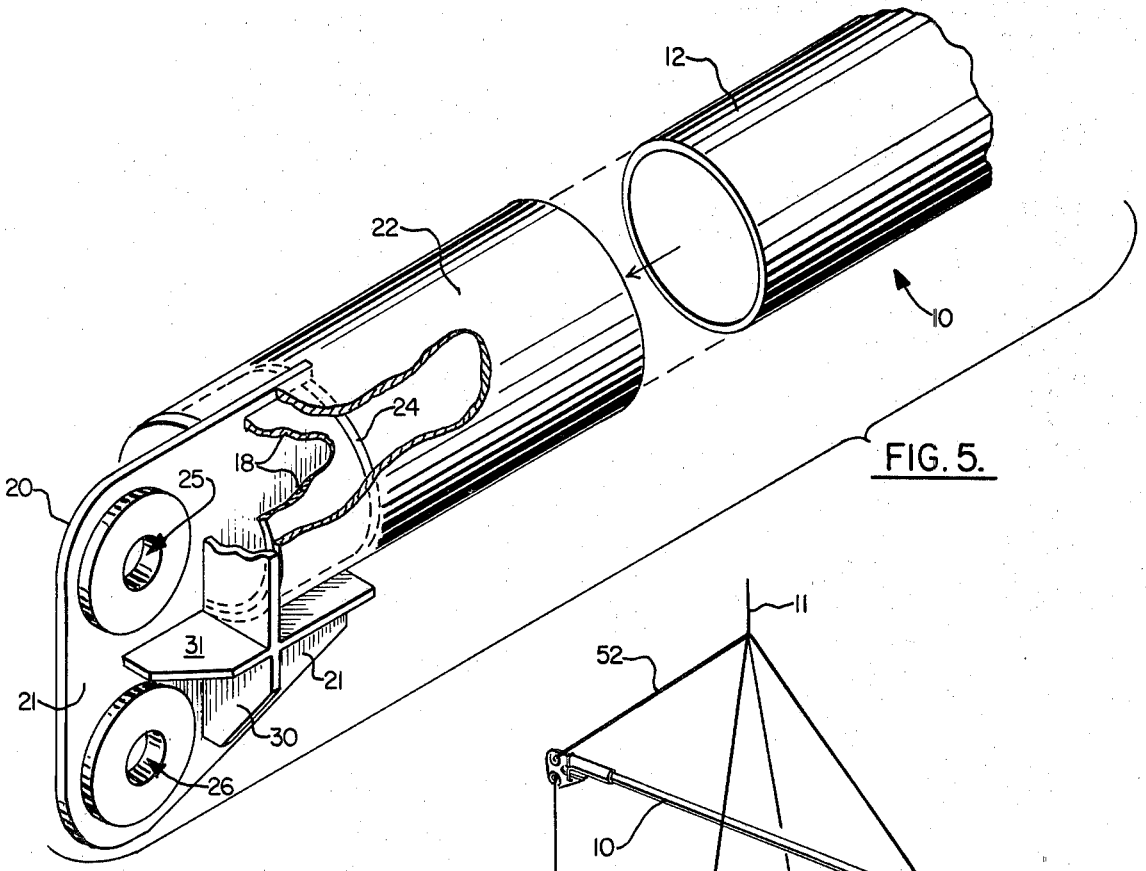
FIG. 5 is a perspective partially cut away view of the apparatus of the present invention illustrating one end connector portion thereof.

In FIG. 1, a side partially sectional view of liting eye assembly 20 is shown providing a cylindrical socket 22 which slips over bar 12. FIG. 5 shows a partially cut away perspective view of lifting eye assembly 20. Note from sectional view 3, that socket 22 would be of an internal diameter substantially equal to or slightly larger than bar 12 and would be of a corresponding cross-section with cylindrical cross-sections being preferred. Bar 12 should slip into socket 22 with minimum tolerance thus providing a good structural connection during the lifting operation. A stop 24 would limit the degree of penetration of bar 12 into socket 22 once bar 12 was placed into the open end 23 portion of socket 22 to complete the spreader bar assembly. Behind stop 24, reinforcing tube 18 is placed extending from vertical gusset plate 30 to stop 24. Reinforcing tube 18 would be cylindrical and preferably of the same diameter and wall thickness as bar 12, thus reinforcing stop 24 against failure by compressive force applied thereto by bar 12.

Figure 2:
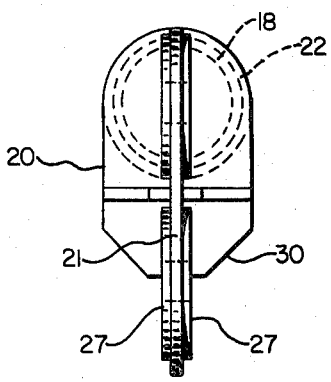
FIG. 2 is an end view of the preferred embodiment of the apparatus of the present invention illustrating one of the end portions thereof.
Figure 3:
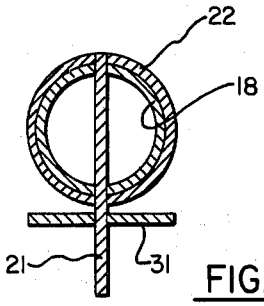
FIG. 3 is a sectional view taken along lines 3—3 of FIG. 1.

A flattened plate 21 would provide a pair of lifting openings 25, 26 which could be thickened by plate 27 if desired. While two separate plates 27 are shown in the preferred embodiment, a continuous plate could also be used for thickening the plate about openings 25, 26. A pair of gussets 30, 31 can also be seen in the drawings including a vertical gusset plate 30 and a horizontal plate 31. Vertical gusset plate 30 as seen in FIG. 2 forms a closure over socket 22 opposite open end 23 and could, in fact, be used as the desired stop as an alternate construction.

Horizontal gusset 31 could be affixed to socket 22 at 40 shown in FIG. 1 by welding, for example, to provide additional reinforcement to flattened plate 21 if desired.

From the above, it can be seen that lifting eye assembly 20 could be manufactured in a variety of dimensional sizes and even in different cross-sectional shapes within the teaching of the present invention such as square using square structural tubing, for example.

It can also be seen that center bar 12 could be precut to a desired dimensional length thus allowing a spreader bar to be instantly constructed in the field at any length.

A load chart could be constructed knowing the structural characteristics of each lifting eye assembly 20 which would permit field welders to know the lifting capability of any spreader bar so assembled without the benefit of extensive structural calculations.

Figure 6:
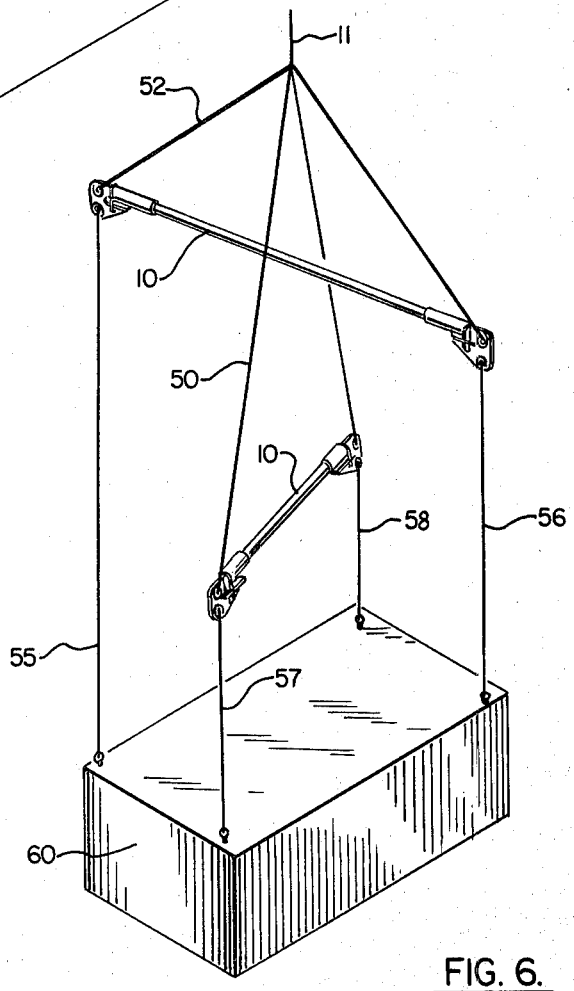
FIG. 6 is a perspective view of the apparatus of the present invention illustrating an alternate lifting arrangement using the preferred embodiment of the apparatus of the present invention, replacing the necesity of a lifting frame.

Thus, the present invention provides a very versatile, highly structurally sound lifting device. In FIG. 6, two spreader bar assemblies 10 are shown providing an easily constructed versatile lifting frame with two bridles 50, 52 depending from load line 11. Four individual downwardly depending lines 55-59 attach to load 60. Using this arrangement, load could be lifted using spreader bars 10 substituting for a complex expensive lifting frame.

The spreader bar assemblies 10 as shown in FIG. 6 thus provide a lifting frame with the primary load line 11branching to a provided bridle in the form of four radially and downwardly branching load lines 50, 52 which are connected at one respective end of each thereof together and at the lower end thereof to bar assemblies 10. Otherwise, bar assemblies 10 would be constructed as shown in FIGS. 1 through 5.

The four depending secondary load lines 55-58 would attach respectively at the upper end thereof to one of the lifting eye assemblies 20 and at the lower end thereof to a load 60 to be lifted. The lines 52 would be of a shorter length generally than the lines 50 forming the bridle and would thus place spreader bar assemblies 10 atop one another and at angles (generally right angles or perpendicular, for example, with square loads) to one another. Depending upon the load to be lifted, the elongated bar portion of each spreader bar assembly could be of any desired length and adjustable within the teaching of the present invention. Thus a highly versatile lifting arrangement can be achieved by the present invention. The spreader bar assemblies 10 of FIG. 6 could be of the same length or of different lengths as desired.

The present invention could be manufactured of any suitable structural material such as structural steel and could be manufactured by fabrication, welding, or any other such techniques of metal construction.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A spreader bar assembly comprising:

a. A rigid elongated support bar;

b. A pair of lifting eye means removably connected during a lifting operation at each respective end portion of said bar for forming a connection with an above supporting bridle line and at least one depending lift line, each of said lifting eye means including an integral female socket for receiving one end of said bar thereinto and having a corresponding internal cross-section equal to or slightly larger than the external cross-section of said support bar; and c. transverse stop means within each of the sockets for abutting the end portion of the elongated support bar thereby limiting the penetration of the bar into the socket, the pair of lifting eye means being freely separable from the bar and held thereto during a lifting operation by forces applied to each of the lifting eye means by load lines attached thereto.

2. The apparatus of claim 1 wherein said bar and each of said sockets are cylindrical.

3. The apparatus of claim 2 wherein said sockets are of an internal diameter equal to or slightly larger than the external diameter of said bar.

4. The apparatus of claim 1 wherein each of said lifting eye means comprises:

a cylindrical socket providing an open end and terminating at an inner stop;

a plate affixed rigidly to said socket and extending downwardly and rearwardly from said open end of said socket;

at least one opening in said plate receptive of lifting lines; and gusset means on said plate for stiffening said plate.

5. A spreader bar assembly comprising:

a. a rigid elongated support bar;

b. a pair of lifting eye means removably connected during a lifting operation at each respective end portion of the bar for forming a connection with an above supporting bridle line and at least one depending lift line, each of said lifting eye means comprising:

a cylindrical socket providing an open end and terminating at an inner stop;

a plate affixed rigidly to the socket and extending downwardly and rearwardly from the open end of the socket;

at least one opening in the plate receptive of lifting lines; and gusset means on the plate for stiffening the plate, the gusset means comprising a vertical gusset affixed rigidly to the plate at an angle thereto, the cylindrical socket at substantially right angles to the longitudinal axis thereof, and a horizontal gusset affixed rigidly to the plate at an angle thereto, the horizontal gusset being affixed in part to the socket.

6. The apparatus of claim 5 wherein said socket provides a cylindrical side wall to which said horizontal gusset is tangently attached.

7. A spreader bar assembly for use with a bridled load line comprising:

a. an elongated integral bar of generally uniform cross-section at its ends;

b. a pair of lifting eye assemblies connected during a lifting operation to each respective end portion of the bar and forming a connection therewith, each of the lifting eye assemblies comprising:

a female socket providing an open end bore of uniform section and terminating at an inner stop plate transversely affixed to the inner portion of the bore, the female socket normally occupying a position abutting the end portion of the elongated support bar;

reinforcing means positioned on the opposite side of the stop plate from the open end bore for strengthening the ability of the stop plate to carry loads transmitted thereto from the bar;

an eyelet plate integral with the socket and extending downwardly and rearwardly from the open end portion of said socket;

at least one eyelet opening in the eyelet plate for connecting the bridle line to the eyelet plate.

8. The apparatus of claim 7 wherein the socket is cylindrical and provides a uniform internal cylindrical bore and said reinforcing means comprises a sleeve in the socket.

9. The apparatus of claim 8 wherein said reinforcement sleeve is of a corresponding section to the elongated bar.

10. The apparatus of claim 7 wherein each of said lifting eye assemblies provides a pair of spaced apart lift eyelet openings.

11. The apparatus of claim 10 wherein said pair of openings are generally vertically aligned.

12. The apparatus of claim 7 wherein said elongated bar is of uniform cylindrical cross section.

13. The apparatus of claim 12 wherein the socket is of uniform cylindrical cross section and of an internal diameter substantially equal to the outer diameter of the elongated bar.

14. The apparatus of claim 7 wherein the eyelet plate is generally coplanar with the axis of said elongated bar.

15. The apparatus of claim 7 further comprising a plurality of gussets transversely affixed to said eyelet plate and connecting structurally to said socket.

16. The apparatus of claim 7 wherein said elongated bar is a single integral structural member.

17. The apparatus of claim 16 wherein said elongated bar is cylindrical and each of the sockets provides a cylindrical recess correspondingly sized to receive an end of said bar thereinto.

18. The apparatus of claim 8 wherein there are a pair of lift openings in the eyelet plate and there is a further provided a multi plate thickened portion of the eyelet plate about each of the openings.

* * * * *